US006877562B2

(12) United States Patent
Bourne

(10) Patent No.: US 6,877,562 B2
(45) Date of Patent: Apr. 12, 2005

(54) OIL WELL PERFORATOR

(75) Inventor: Brian Bourne, Sevenoaks (GB)

(73) Assignee: Qinetiq Limited, Hants (GB)

( * ) Notice: Subject to any disclaimer, the term of this patent is extended or adjusted under 35 U.S.C. 154(b) by 0 days.

(21) Appl. No.: 10/250,781

(22) PCT Filed: Jan. 23, 2002

(86) PCT No.: PCT/GB02/00275

§ 371 (c)(1),
(2), (4) Date: Jul. 9, 2003

(87) PCT Pub. No.: WO02/063134

PCT Pub. Date: Aug. 15, 2002

(65) Prior Publication Data

US 2004/0060734 A1 Apr. 1, 2004

(30) Foreign Application Priority Data

Feb. 6, 2001 (GB) ..... 0102914

(51) Int. Cl.[7] ..... E21B 43/117

(52) U.S. Cl. ..... 166/297; 166/55.1; 175/4.55; 175/4.6

(58) Field of Search ..... 166/297, 55.1; 175/4.6, 4.55; 102/320

(56) References Cited

U.S. PATENT DOCUMENTS 2,669,928 A * 2/1954 Sweetman ..... 175/4.6
2,758,543 A * 8/1956 Grandin ..... 175/4.6
2,782,715 A * 2/1957 Udry ..... 175/4.6
2,809,585 A * 10/1957 Moses ..... 102/476
2,946,283 A * 7/1960 Udry ..... 175/4.5
2,984,307 A * 5/1961 Barnes ..... 175/4
3,089,416 A 5/1963 Bruce
3,358,780 A * 12/1967 Venghiattis ..... 175/4.5
3,695,368 A 10/1972 Lanmon
4,004,515 A 1/1977 Mallory et al.
4,185,702 A 1/1980 Bullard
4,253,523 A 3/1981 Ibsen
4,619,333 A 10/1986 George
4,714,022 A 12/1987 Chaumeau et al.
5,567,906 A * 10/1996 Reese et al. ..... 102/307
6,167,811 B1 1/2001 Walkers

* cited by examiner

*Primary Examiner*—Hoang Dang
(74) *Attorney, Agent, or Firm*—Nixon & Vanderhye P.C.

(57) ABSTRACT

This invention relates to the field of oil wells and in particular to the explosive and other devices that are used to perforate oil well casings and hydrocarbon bearing rocks in order to create channels through which oil and gas can flow into the well bore. Existing oil well perforators are either termed "big hole" perforators which are designed to produce large holes in the oil well casing only or "deep hole" perforators which are designed to perforate the casing of the well into the surrounding rocks. This invention proposes a novel "dual action" perforator capable of substantially performing the same functions as both deep hole and big hole perforators.

10 Claims, 2 Drawing Sheets

OIL WELL PERFORATOR

This application is the US national phase of international application PCT/GB02/00275 filed 23 Jan. 2002, which designated the US.

This invention relates to the field of oil wells and in particular to the explosive and other devices that are used to perforate oil well casings and hydrocarbon bearing rocks in order to create channels through which oil and gas can flow into the well bore.

The metal casing of an oil well bore is surrounded by cement which is in turn in contact with the hydrocarbon bearing rocks. Oil well perforators generally perforate oil well casings in one of two ways. Deep hole perforators are designed to produce a high level of perforation through the metal casing and cement into the hydrocarbon bearing rocks. Big hole perforators are designed to produce large holes in the casing only.

Existing perforators are deployed down the oil well casing by mounting them in a gun and hundreds may be used at any one time.

Both deep hole and big hole perforators use a form of shaped hollow charge. In its most common configuration a shaped charge consists of a cylindrical tubular casing containing a hollow metal liner, mounted so that its axis of symmetry is coincident with that of the casing. The liner shape is most commonly conical although other geometrics such as hemispheres or trumpets can be used. The base of the liner is at the end of the cylinder facing the target and explosive is packed within the casing and around the outside of the liner. When the explosive is detonated at the end of the cylinder furthest from the target, a detonation front sweeps the liner causing it to collapse and produce a high velocity jet of liner material which is directed towards the target. A history of shaped charge warheads can be found in *Fundamentals of Shaped Charges* by Walters W. P. and Zukas J. A. (ISBN 0-171-62172-2 (1989)).

The hollow lines used in big hole perforators are generally parabolic in shape and are made of 60Cu/40Zn brass. The apex of the liner has a hole in it which facilitates the formation of a large diameter jet (larger than if the liner surface continued all the way to the apex). For typical pipe diameters (on the order of 100 mm), big hole perforators have a diameter of approximately 42 mm with a hole of diameter 10 mm in the apex of the liner. This configuration is capable of producing a hole of approximately 20–25 mm), in the oil well casing.

A drawback of shaped charge based perforators is that the geometry of the shaped charge is incapable of producing a hole greater than that of the diameter of the charge. Shaped charge based big hole perforators are therefore limited in the size of hole they can produce (Larger holes can be produced mechanically by milling or grinding for example, but these processes are time consuming and costly).

The shaped charges used in deep hole perforators, in contrast to the big hole perforators, do not have holes in the apex of the liner material. For these perforators a narrow, fast moving jet is required to provide a high level of perforation through the casing, concrete and hydrocarbon bearing rock.. The deep hole perforators should also be low cost and amenable to high volume production.

It is clear that the differing geometries of the deep hole and big hole perforator shaped charges mean that it is not usually feasible to use a single charge to achieve both effects simultaneously. However, the highest oil and gas flows would be achieved by producing a large hole in the casing and at the same time a high level of perforation through the casing, concrete and hydrocarbon bearing rock.

It is therefore an object of the present invention to provide a "dual action" oil well perforator which is substantially capable of performing the same functions as both deep hole and big hole perforators.

Accordingly this invention provides a tandem oil well perforator comprising i) a substrate, ii) a linear cutting charge mounted upon the substrate iii) first detonation means for detonating the cutting charge iv) at least one hollow liner shaped charge mounted upon the substrate; and v) second detonation means for detonating the hollow liner shaped charge wherein vi) the substrate, cutting charge and the at least one shaped charge are adapted for location within an oil well, and vii) the substrate, cutting charge and the at least one shaped charge are configured such that in use detonation of the cutting charge by the first detonation means cuts a hole in the oil well casing and detonation of the at least one shaped charge by the second detonation means causes a highly penetrating jet or jets to be projected through the hole in the casing.

The substrate should be any suitable means of supporting the charges in a manner that will not interfere with their operation. For example, the charges could be carried on a friable substrate which disintegrates upon detonation of the charges. Alternatively, a conventional gun deployment system which is common in the oil and gas industries may be used. Such gun systems would be sufficiently robust to be withdrawn from the well bore after firing. A further alternative would be a so-called "full flow gun system". Such a gun system would be arranged to disintegrate upon firing in much the same way as the friable substrate mentioned above.

In the case of a friable substrate, the substrate should be sufficiently friable such that following detonation of the cutting charge and shaped charge(s) it disintegrates and the debris falls down the oil well pipe. Preferably therefore the substrate is made of a blown ceramic material. Such materials are relatively light and are capable of easy machining thereby allowing complex shaped grooves to be created for support of the cutting charge/shaped charge(s). Such materials are also sufficiently robust to be deployed down the pipe. An example of a suitable ceramic material is AL 203 manufactured by Friatec DPL in France.

This invention utilises explosive cutting charges to cut the oil well casing. Such charges can be flexible linear shaped charges comprising explosive which has been extruded together with a metal or plastic sheath (The cutting charge may be copper, silver or polymer lined). However, other versions of explosive cutting charges may be rigid and pre-formed into a preferred shape or configuration. These cutting cords can be made into any size and can be configured into any shape required. In use these charges chop the well bore casing into pieces that do not subsequently interfere with down hole activities.

A hollow liner shaped charge is then used to provide a high level of perforation through the hole in the casing and into the surrounding concrete and hydrocarbon bearing rocks. The substrate may carry one or more of these shaped charges depending on the level of deep hole penetration required. If multiple shaped charges are used they can conveniently be formed into a focusing array for greater penetrative power.

The use of two perforating charges in a down hole environment enhances oil and gas flow and also enhances other activities such as the deployment of instrumentation and sensors.

Conveniently there is a time delay between the detonation of the cutting charge and the detonation of the shaped charge(s). Traditionally, a shaped charge is detonated by detonating the explosive at that part of the shaped charge which is furthest from the target. Therefore, a small time delay can be inserted between the firing of the first and second detonation means.

However, a shaped charge can be reverse initiated, i.e. the charge can be detonated by detonating the explosive that lies at the points closest to the target (For the case of a conical liner this would equate to initiating detonation at the periphery of the base of the cone). Therefore, conveniently if the shaped charge is reverse initiated then the first detonation means can also be used as the second detonation means.

The gape of the cutting cord (which is defined as the distance across the mouth of the linear charge) can be made into any size appropriate to the thickness of the metal to be cut. The cutting cords should be at a reasonably constant distance from the metal to be cut, preferably around one gape length.

Preferably the shaped charge(s) should be lined with a material known to be effective at penetrating concrete. Copper or preferably a very dense material such as a tungsten rich alloy should be used. However, other wrought or green compacted powder liner material, both metallic and non-metallic, may be equally advantageous.

Conveniently, the invention can be mounted on a reusable gun arrangement similar to existing systems.

Correspondingly there is provided a method of producing holes in the casing of oil wells and simultaneously producing perforation into the area surrounding the oil well comprising the steps of:

i) placing an oil well perforator according to the present invention in an oil well at a location where it is desired to produce a hole; and ii) detonating the oil well perforator.

In a second aspect of the invention, a dual action oil well perforator comprises a conventional deep hole perforator and a conventional big hole perforator operating in tandem. According to this second aspect of the invention a tandem oil well perforator comprises i) a substrate, ii) a first hollow liner shaped charge mounted upon the substrate iii) first detonation means for detonating the first hollow liner shaped charge iv) a second hollow liner shaped charge mounted upon the substrate; and v) second detonation means for detonating the second hollow liner shaped charge wherein vi) the substrate and shaped charges the adapted for location within an oil well, and vii) the substrate and shaped charges are configured such that is use detonation of the first hollow liner shaped charge by the first detonation means cuts a hole in the oil well casing and detonation of the second hollow liner shaped charge by the second detonation means causes a highly penetrating jet to be projected though the hole in the casing, the detonation of the shaped charges being sufficient to disintegrate the friable substrate.

Similar substrate configurations as described for the first aspect of the invention above can be used in this second aspect of the invention.

Correspondingly there is provided a method of producing holes in the casing of oil wells and simultaneously producing perforation into the area surrounding the oil well comprising the steps of:

iii) placing an oil well perforator according to the second aspect of the present invention in an oil well at a location where it is desired to produce a hole; and iv) detonating the oil well perforator.

In this second aspect of the invention a conventional big hole perforator first cuts a hole in the oil well casing and then a conventional deep hole perforator provides a high level of perforation through the hole in the casing and into the surrounding concrete and hydrocarbon bearing rocks. The dimensions of typical perforator charges means that this second aspect of the invention is more conveniently deployed in larger diameter pipes of the order 12 centimeters in diameter and above.

Embodiments of the oil well perforator according to the present invention will now described with reference to the accompanying drawings in which.

Figure 1:
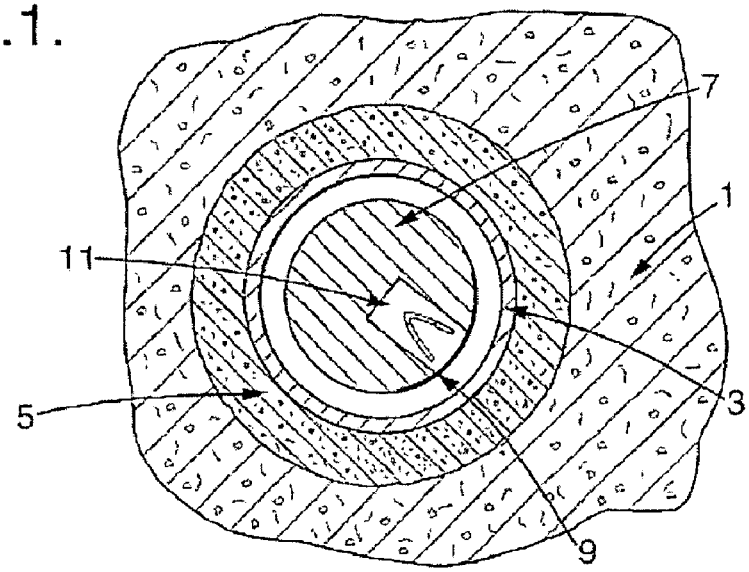
FIG. 1 shows a view of the tandem perforator and oil well in cross section
Figure 3:
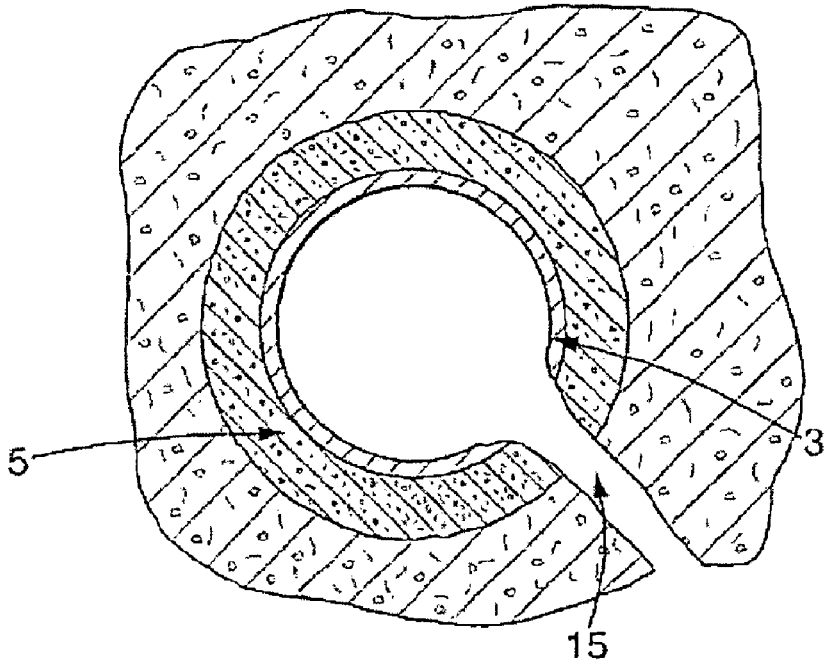
Figure 4:
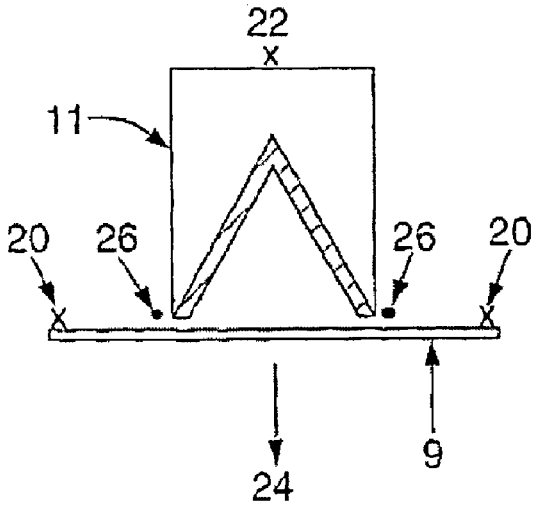

FIG. 3 shows the oil well in cross section after the perforator has been fired FIG. 4 shows alternative ways of initiating detonation of the perforator FIG. 1 shows an oil well that has been bored into hydrocarbon bearing rocks 1. The oil well comprises a metal casing 3 which is surrounded by a concrete layer 5 which separates it from the rocks 1.

The oil well perforator (7, 9, 11) comprises a friable substrate 7, a cutting charge 9 and a shaped charge 11. (The detonators for the cutting charge and shaped charge are not shown).

Figure 2:
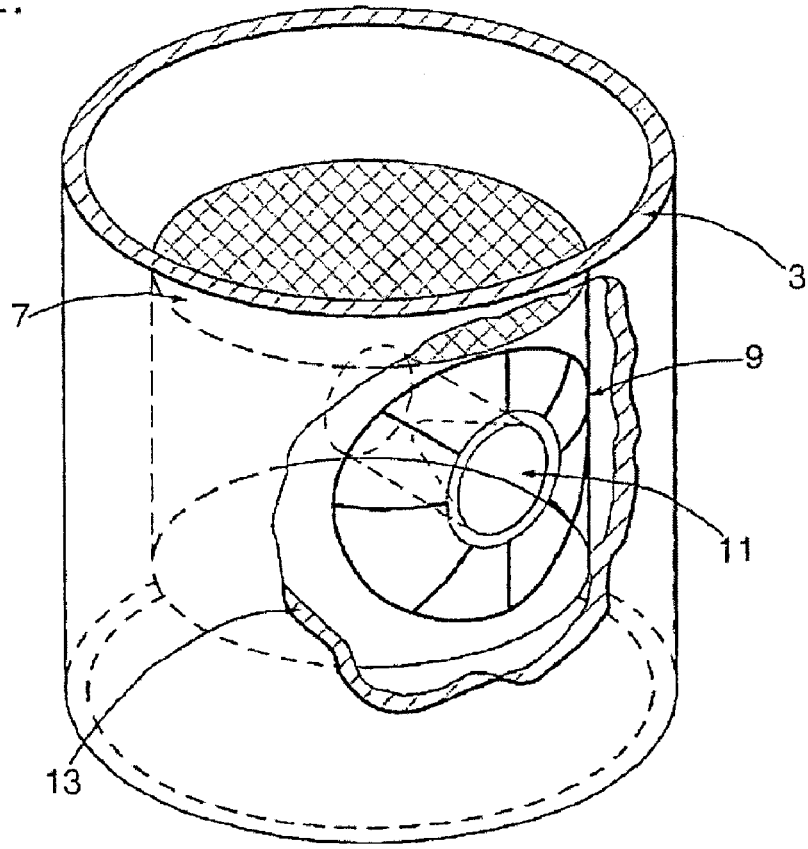
FIG. 2 shows the oil well casing and oil well perforator in cutaway

FIG. 2 shows a 3-dimensional view of part of the metal pipe 3 depicted in FIG. 1 (Note: like numerals are used to denote like features). A window 13 has been cut away in the side of the pipe in order to show the configuration of the cutting charge 9 upon the substrate 7. The configuration of the cutting charge 9 will be dependent upon the hole desired in the metal casing 3. In this case the cutting charge has been formed into an approximation of a spoked wheel. The shaped hollow charge 11 is visible at the centre of the wheel arrangement.

Upon detonation of the cutting charge 9 by the first detonator (not shown) a hole will be cut in the metal casing 3. For the configuration shown a hole similar to the cutaway window 13 will be formed. After a short time delay the second detonator will detonate the shaped hollow charge 11 which will penetrate the concrete and rock beyond the hole in the casing. Debris from the casing 3 and the substrate 7 will fall down the well.

The detonation of the cutting charge 9 will be a complex procedure but it should be designed such that the cord element on the periphery of the wheel detonates substantially simultaneously.

FIG. 3 depicts the cross sectional view of FIG. 1 after the tandem perforator has been fired. The perforator (7, 9, 11) and casing fragments have now fallen down the well and are no longer visible. The detonation of the shaped hollow charge has produced a deep hole 15 in the concrete and rock.

FIG. 4 depicts various ways of initiating the perforator (7, 9, 11) shown in FIGS. 1 and 2. The perforator comprises a shaped hollow charge 11 and cutting cord 9. In a traditional mode of operation the cutting cord will first be detonated by first detonation means (not shown) at positions 20. After a short time delay the shaped hollow charge will be initiated by the second detonator (not show) at position 22 resulting in a penetrating jet in the direction 24.

In an alternative mode of operation the first detonator also acts as the second detonator. In this case the tandem perforator is initiated at positions 26. This results in the detonation of the cutting cord almost simultaneously and the reverse initiation of the shaped hollow charge. This removes the requirement to build in a time delay between two separate detonators.

Other ways s of configuring the cutting charge and shaped charge will be readily apparent to the skilled person.

What is claimed is:

1. A tandem oil well perforator comprising:

i) a substrate;

ii) a linear cutting charge mounted upon the substrate;

iii) first detonation means for detonating the cutting charge;

iv) at least one hollow liner shaped charge mounted upon the substrate; and v) second detonation means for detonating the hollow liner shaped charge wherein the substrate, cutting charge and the at least one shaped charge are adapted for location within an oil well, and the substrate, cutting charge and the at least one shaped charge are configured such that in use detonation of the cutting charge by the first detonation means cuts a hole in the oil well casing and detonation of the at least one shaped charge by the second detonation means causes a highly penetrating jet or jets to be projected through the hole in the casing.

2. A tandem oil well perforator as claimed in claim 1 wherein the substrate is friable.

3. A tandem oil well perforator as claimed in claim 2 wherein the friable substrate comprises a blown ceramic material.

4. A tandem oil well perforator as claimed in claim 1 and further including means for causing a small time delay between the detonation of the first detonation means and the detonation of the second detonation means.

5. A tandem oil well perforator as claimed in claim 1 wherein the first detonation means also acts as the second detonation means.

6. A tandem oil well perforator as claimed in claim 1 wherein the cutting charge is located at a substantially constant distance from the casing of the oil well.

7. A tandem oil well perforator as claimed in claim 4 wherein the cutting charge is located at a distance of approximately one gape length from the casing.

8. A tandem oil well perforator as claimed in claim 1 wherein the hollow liner shaped charge liner material comprises a tungsten rich alloy.

9. A tandem oil well perforator as claimed in claim 2, wherein the shaped charge is sufficiently large to disintegrate the friable substrate.

10. A method of producing holes in the casing of oil wells and simultaneously producing perforation into the area surrounding the oil well comprising the steps of:

i) placing an oil well perforator according to claim 1 in an oil well at a location where it is desired to produce a hole; and ii) detonating the oil well perforator.

* * * * *